United States Patent [19]

Blome

[11] Patent Number: 4,659,078

[45] Date of Patent: Apr. 21, 1987

[54] FLUID DYNAMIC EXERCISER

[76] Inventor: Victor S. Blome, 29 Sidney Dr., Savannah, Ga. 31406

[21] Appl. No.: 530,702

[22] Filed: Sep. 9, 1983

[51] Int. Cl.[4] ..... A63B 21/00

[52] U.S. Cl. ..... 272/128; 272/143; 272/130

[58] Field of Search ..... 272/93, 116, 117, 119, 272/122, 123, 124, 128, 143, 130; 206/315.1; 383/6

[56] References Cited

U.S. PATENT DOCUMENTS

| | | | |
|---|---|---|---|
| 1,005,791 | 10/1911 | Angell | 272/124 |
| 3,756,592 | 9/1973 | Johnson | 272/128 |
| 3,843,117 | 10/1974 | Johnson | 272/128 |
| 3,997,159 | 12/1976 | Malhas | 273/29 A |
| 4,026,549 | 5/1977 | Gunn | 272/143 X |
| 4,253,664 | 3/1981 | Daulton | 273/29 A |
| 4,332,379 | 6/1982 | Bannister | 272/119 |
| 4,450,580 | 5/1984 | Lindsay | 383/6 |

*Primary Examiner*—Richard J. Apley
*Assistant Examiner*—Robert W. Bahr
*Attorney, Agent, or Firm*—Norman E. Lehrer

[57] ABSTRACT

A device is disclosed for use by a person for dynamically exercising muscles comprising first holding apparatus and second holding apparatus secured to a flexible enclosure which holds fluid, whereby when the person moves the first holding apparatus and the second holding apparatus, movement of the fluid within the flexible enclosure results in dynamically exercising muscles of the person.

11 Claims, 10 Drawing Figures

FLUID DYNAMIC EXERCISER

This invention relates to an exerciser and more particularly to an exercise device which is dynamic in scope.

Conventional-type weights for exercise purposes are restricted in movement. In utilizing conventional-type weights, a limited portion of muscles can be exercised at a given time. Conventional-type weights are heavy, bulky, and not conveniently mobile. The present invention provides for a fluid dynamic exerciser which can be conveniently utilized to exercise a variety of muscle groups within the body.

An object of the present invention is to provide for an exerciser which comprises a fluid containing enclosure which can be utilized to exercise a variety of muscles within the body.

Another object of the present invention is to provide a fluid dynamic exerciser in which exercise movements may be accomplished in a variety of vertical and horizontal planes with rotational-type movements.

Still another object of the present invention is to provide a fluid dynamic exerciser which can be utilized in positions above, below, in front of, and behind the upper torso of the body.

A further object of the present invention is to provide a fluid dynamic exerciser which can be held by a plurality of holding positions.

Another object of the present invention is to provide a fluid dynamic exerciser in which the holding means can be secured to the fluid containing enclosure by a plurality of connecting means.

Still another object of the present invention is to provide a fluid dynamic exerciser in which a different group of muscles can be exercised by varying the holding position of the fluid dynamic exerciser.

A further object of the present invention is to provide a fluid dynamic exerciser in which the amount of fluid can be varied within the fluid containing enclosure to adjust the weight of the fluid within the fluid containing enclosure.

Another object of the present invention is to provide a fluid dynamic exerciser in which the amount of fluid can be varied within the fluid containing enclosure to adjust the weight of the fluid within the fluid containing enclosure while utilizing the fluid dynamic exerciser.

These and other objects and features of the invention will be apparent from the following description and appended claims.

Briefly, the invention is a device for use by a person for dynamically exercising muscles. The device has a first holding means, a second holding means, a flexible enclosure, a first connecting means, and a second connecting means. The first holding means is operative to be held by the person in a first hand. The second holding means is operative to be held by the person in a second hand. The flexible enclosure is operable to hold fluid and is secured to the first holding means and the second holding means. The first connecting means secures the first holding means to the flexible enclosure. The second connecting means secures the second holding means to the flexible enclosure.

The first hand and the second hand may be moved, causing movement of the fluid in the flexible enclosure resulting in dynamically exercising muscles of the person. The first hand and the second hand may be moved in a vertical and horizontal plane, along with rotational movements. The first hand and the second hand may be moved in front of the upper torso of the person. The first hand and the second hand may be behind the upper torso of the person. The first hand and the second hand may be below the upper torso of the person. The first hand and the second hand may be moved above the upper torso of the person.

Various quantities of fluid may be placed within the flexible enclosure in order to dynamically exercise different muscles of the person. The first hand and the second hand may be moved at varying speeds in order to dynamically exercise different muscles of the person. The first holding means and the second holding means may be held by the person in differing manners in order to dynamically exercise different muscles of the person.

The flexible enclosure contains one or more fill-holes in order to add or subtract quantities of the fluid from the flexible enclosure. The quantities of the fluid may be removed from the flexible enclosure while utilizing the device.

The first holding means comprises a flexible, tubular strap. The first connecting means may comprise a plurality of split ends of the flexible enclosure placed within a plurality of ends of the flexible, tubular strap. Sealing means is operative to seal the plurality of split ends of the flexible enclosure within the plurality of ends of the flexible, tubular strap. A secondary sealing means further seals the plurality of split ends of the flexible enclosure within the plurality of ends of the flexible, tubular strap. The secondary sealing means may comprise stitches placed through the plurality of split ends of the flexible enclosure and the plurality of ends of the flexible, tubular strap. A pressure-relieving seal may be placed over the secondary sealing means and the sealing means to insure that the fluid within the flexible enclosure does not escape through the first connecting means.

The second connecting means may be constructed in the same manner as the first connecting means. The first holding means may be constructed in the same manner as the second holding means. The first holding means and the second holding means may have handle padding for the comfort of the person.

The invention will be more fully understood from the following detailed description and appended claims when taken with the drawings in which:

FIG. 1 is an illustration of fluid dynamic exerciser 1 in use by a person 8 having the fluid dynamic exerciser 1 extended outward from the right hand 6 of person 8, with centrifugal force 11 acting in a right-hand horizontal direction and gravitational force 12 acting in a downward direction upon the fluid 3 within the fluid containing enclosure 2 of fluid dynamic exerciser 1.

FIG. 2 is an illustration of fluid dynamic exerciser 1 in use by a person 8 with the fluid dynamic exerciser 1 in a vertical position showing the centrifugal force 11 and the gravitational force 12 acting in a downward direction upon the fluid 3 within the fluid containing enclosure 2 of the fluid dynamic exerciser 1.

FIG. 3 is an illustration of fluid dynamic exerciser 1 in use by a person 8 having the fluid dynamic exerciser 1 extended outward from the left hand 7 of person 8, with centrifugal force 11 acting in a left-hand horizontal direction and gravitational force 12 acting in a downward direction upon the fluid 3 within the fluid containing enclosure 2 of fluid dynamic exerciser 1.

FIG. 4 is an illustrative view of fluid dynamic exerciser 1 showing fill-holes 21, 22, and 23.

Figure 7:
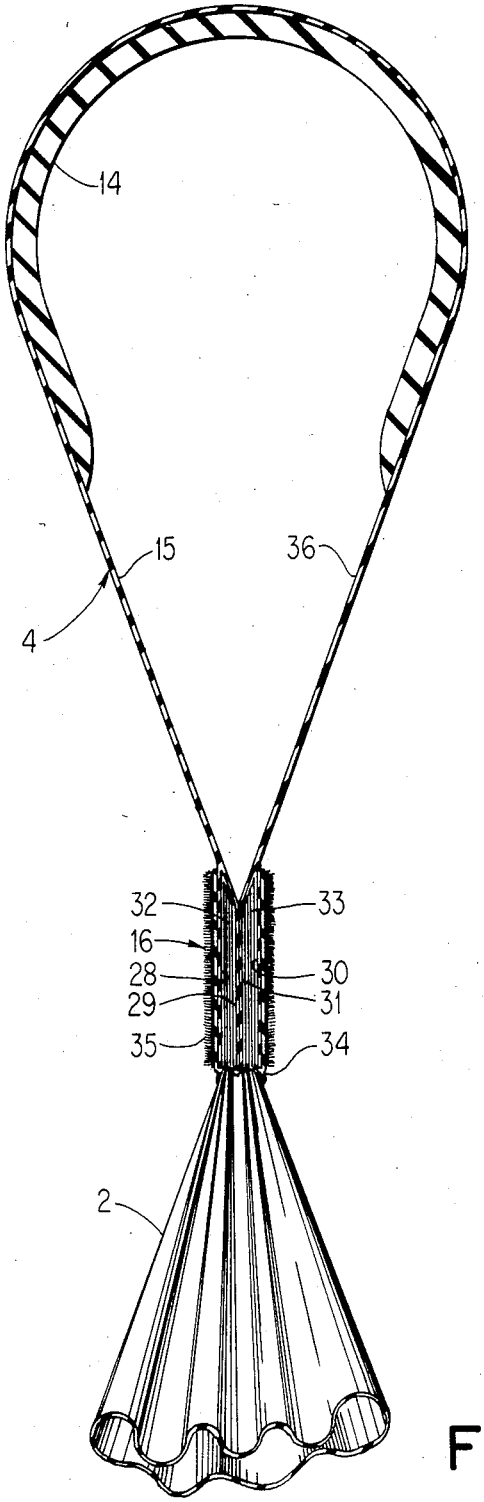

FIG. 7 is an enlarged partial sectional view of handle assembly 4, connecting means 16, and fluid containing enclosure 2.

Figure 8:
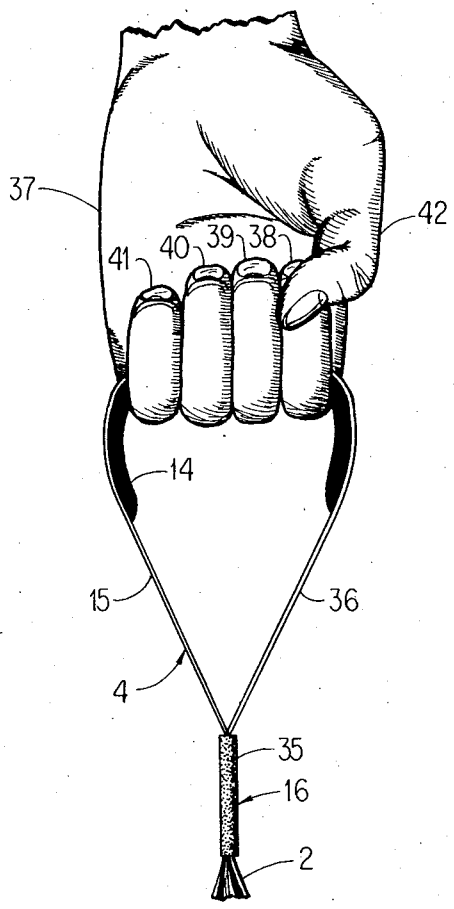

FIG. 8 is an illustrative view of a first method of utilizing handle assembly 4 within hand 37.

Figure 9:
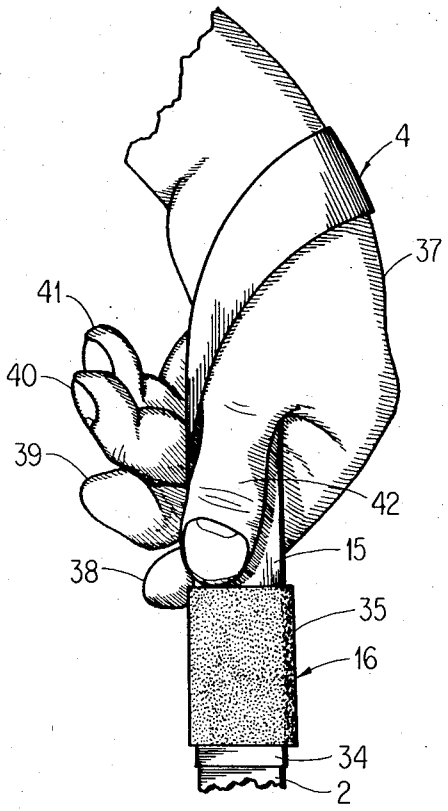

FIG. 9 is an illustrative view of a second method of utilizing handle assembly 4 within hand 37.

Figure 10:
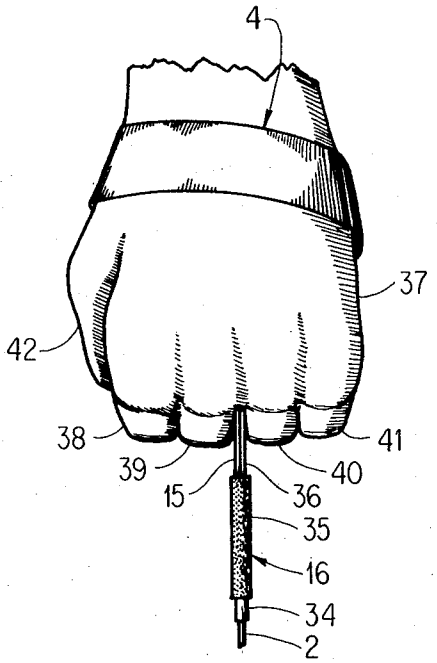

FIG. 10 is an illustrative view of a third method of utilizing handle assembly 4 within hand 37.

Figure 1:
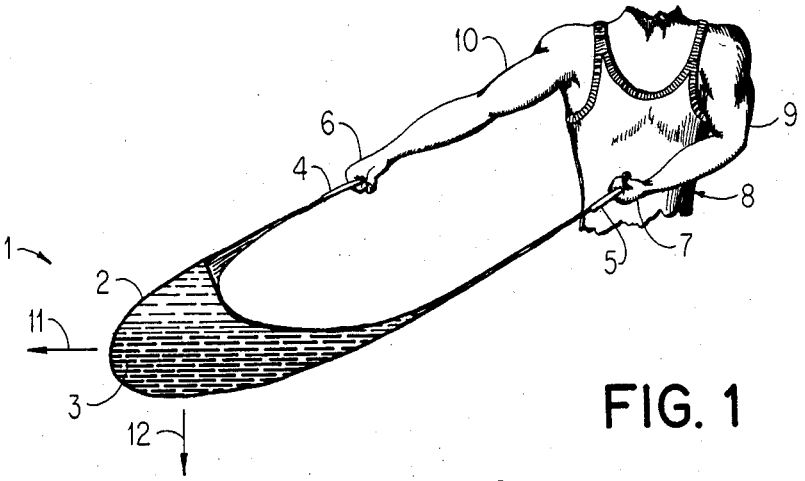

Referring now to the drawings, FIG. 1 is an illustration of fluid dynamic exerciser 1 in use by a person 8 having the fluid dynamic exerciser 1 extended outward from the right hand 6 of person 8, with centrifugal force 11 acting in a right-hand horizontal direction and gravitational force 12 acting in a downward direction upon the fluid 3 within the fluid containing enclosure 2 of fluid dynamic exerciser 1. Fluid dynamic exerciser 1 has a fluid containing enclosure 2, a handle assembly 4, and a handle assembly 5. Handle assembly 4 is shown held in the right hand 6 of the person 8. Handle assembly 5 is shown held in the left hand 7 of the person 8.

In FIG. 1, the fluid dynamic exerciser 1 is extended outward from the right hand 6 of the person 8, with the right arm 10 extended outward. The left arm 9 is shown bent at the elbow and fairly tight into the body of the person 8.

The gravitational force 12 always acts in a downward direction. The centrifugal force 11 acts in an appropriate direction, depending upon the position and movement of the fluid 3 within fluid containing enclosure 2. In FIG. 1, the centrifugal force 11 is acting in a right-hand horizontal direction.

Figure 2:
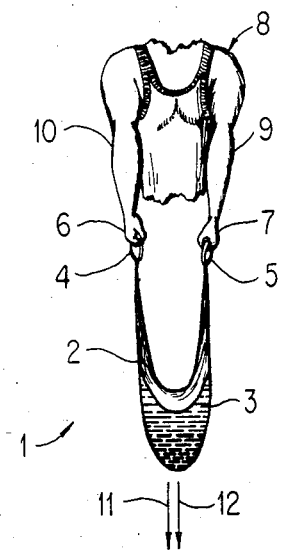

FIG. 2 is an illustration of fluid dynamic exerciser 1 in use by a person 8 with the fluid dynamic exerciser 1 in a vertical position showing the centrifugal force 11 and the gravitational force 12 acting in a downward direction upon the fluid 3 within the fluid containing enclosure 2 of the fluid dynamic exerciser 1. The fluid dynamic exerciser 1 is shown with fluid containing enclosure 2, handle assembly 4, and handle assembly 5. Handle assembly 4 is in right hand 6. Handle assembly 5 is in left hand 7.

Right arm 10 and left arm 9 are shown tight into the body of the person 8, with the arms 9 and 10 extended downward. Centrifugal force 11 and gravitational force 12 act together in a downward direction upon the fluid 3 within the fluid containing enclosure 2.

Figure 3:
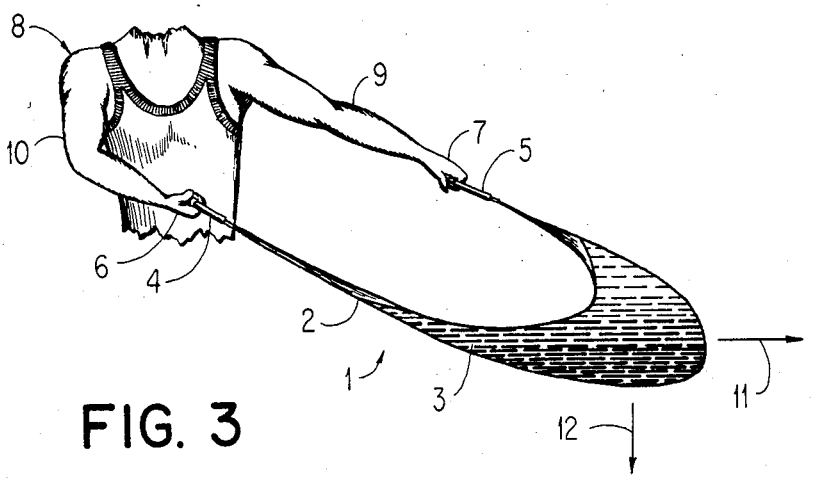

FIG. 3 is an illustration of fluid dynamic exerciser 1 in use by a person 8 having the fluid dynamic exerciser 1 extended outward from the left hand 7 of person 8, with centrifugal force 11 acting in a left-hand horizontal direction and gravitational force 12 acting in a downward direction upon the fluid 3 within the fluid containing enclosure 2 of fluid dynamic exerciser 1. Fluid dynamic exerciser 1 has fluid containing enclosure 2, handle assembly 4, and handle assembly 5. Handle assembly 4 is shown held in right hand 6 of person 8. Handle assembly 5 is shown held in left hand 7 of the person 8.

In FIG. 3, the fluid dynamic exerciser 1 is extended outward from the left hand 7 of the person 8, with the left arm 9 extended outward. The right arm 10 is shown bent at the elbow, but fairly tight into the body of person 8.

The gravitational force 12 always acts in a downward direction. The centrifugal force 11 acts in an appropriate direction, depending upon the position and movement of the fluid 3 within fluid containing enclosure 2. In FIG. 3, the centrifugal force 11 is acting in a left-hand horizontal direction.

Figure 4:
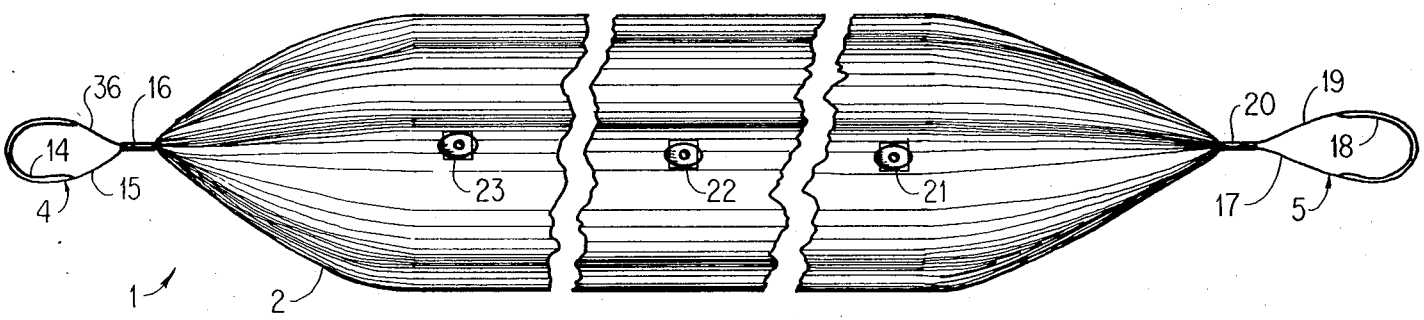

FIG. 4 is an illustrative view of fluid dynamic exerciser 1 showing fill-holes 21, 22, and 23. Handle assembly 4 is shown with handle padding 14 and handle strip side pieces 15 and 36. Connecting means 16 connects handle assembly 4 to fluid containing enclosure 2. Handle assembly 5 is shown with handle padding 18 and handle strap side pieces 17 and 19. Connecting means 20 connects handle assembly 5 to fluid containing enclosure 2.

Fluid 3 can be placed within fluid containing enclosure 2 through fill-holes 21, 22, or 23. Fluid 3 can also be removed from fluid containing enclosure 2 through fill-holes 21, 22, or 23.

Figure 5:
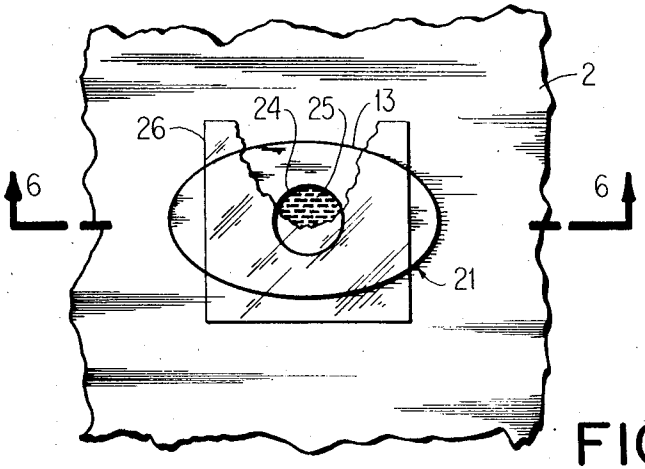
FIG. 5 is an enlarged partial elevational view of fluid containing enclosure 2 detailing the portion thereof including fill-hole 21.

FIG. 5 is an enlarged partial elevational view of fluid containing enclosure 2 detailing the portion thereof including fill-hole 21. Fill-hole 21 has an opening 24 within a fill-hole reinforcement ring 13. Fluid 25, a portion of fluid 3, is shown within opening 24. The fluid 25 may be placed within or expelled from the fluid containing enclosure 2 through the opening 24 of fill-hole 21. A fill-hole cover 26 secures over fill-hole reinforcement ring 13 and a portion of fluid containing enclosure 2 to seal closed the opening 24 of fill-hole 21 in order to prevent fluid 25 from escaping through opening 24 of fill-hole 21. Fill-hole cover 26 may be simply a flush piece of tape with sufficient strength to hold onto the fill-hole reinforcement ring 13 and a portion of fluid containing enclosure 2 to prevent fluid 25 from escaping through opening 24, while remaining basically flush with the outer covering of fluid containing enclosure 2.

Figure 6:
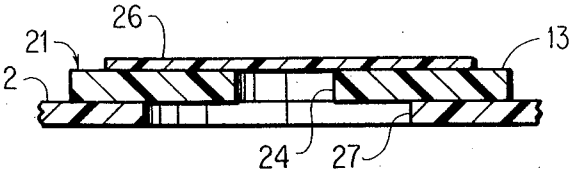
FIG. 6 is a partial sectional view of fill-hole 21 taken at section 6—6 of FIG. 5.

FIG. 6 is a partial sectional view of fill-hole 21 taken at section 6—6 of FIG. 5. Fluid containing enclosure 2 has an opening 27. Fill-hole reinforcement ring 13 has an opening 24. The fluid 25, a portion of fluid 3, could be added or removed through opening 27 in fluid containing enclosure 2, and opening 24 in fill-hole reinforcement ring 13.

Fill-hole cover 26, when in place, prevents the filling or removal of the fluid 25. Fill-hole cover 26 may be any desired closing means. Fill-hole cover 26 should be relatively flat so that the fill-hole cover 26 may fit flush with the outer portion of fluid containing enclosure 2 and not interfere with the utilization of the fluid dynamic exerciser 1.

The fill-holes 21, 22, and 23 should not rub against the user of the fluid dynamic exerciser 1 in any manner that would interfere with the use of the fluid dynamic exerciser 1. Fill-holes 21, 22, and 23 may be of any desired design or configuration, with the criteria that the design and configuration not interfere with the user of the fluid dynamic exerciser 1.

FIG. 7 is an enlarged partial sectional view of handle assembly 4, connecting means 16, and fluid containing enclosure 2. FIG. 7 is also illustrative of an enlarged partial sectional view of handle assembly 5, connecting means 20, and fluid containing enclosure 2. Handle assembly 4 and handle assembly 5 are similar. Connecting means 16 and connecting means 20 may be similar. Handle assembly 4 is shown with handle padding 14, which may be optional.

Handle assembly 4 is illustrated having handle strap side pieces 15 and 36. In actuality, handle strap side pieces 15 and 36 may be one continuous strap means. Handle strap side pieces 15 and 36 may be basically a hollow tubing, the end of which may hold a split portion of fluid containing enclosure 2 to aid in connecting handle assembly 4 to fluid containing enclosure 2 within connecting means 16.

The end handle strap side piece 15 is illustrated in the sectional view to have portions 28 and 29. The end of handle strap side piece 36 is illustrated to have portions 30 and 31. Fluid containing enclosure 2 has an end which is shown split in two, split portion 32 and split portion 33. Split portion 32 is shown placed within the hollow tubing of handle strap side piece 15 surrounded by the portions 28 and 29 in the sectional view. The split portion 33 is shown placed within the hollow tubing of handle strap side piece 36 surrounded by the portions 30 and 31 in the sectional view.

The split portion 32 shown within portions 28 and 29 of handle strap side piece 15, and the split portion 33 shown within portions 30 and 31 of handle strap side piece 36, are sealed together. The initial sealing may be accomplished by a heat sealing device. Secondary sealing means is then utilized to further seal the portions together. The secondary sealing means may be stitching. The stitching would secure the portions together utilizing a thread means.

After the initial sealing and the secondary sealing, the connecting means 16 is covered with a pressure-relieving seal 34. The pressure-relieving seal 34 covers the initial seal and the secondary seal. The pressure-relieving seal 34 may be a tape which covers the initial seal and the secondary seal. A covering portion 35 may be placed over the pressure-relieving seal 34 in order to protect the sealing portions of connecting means 16 and to prevent any roughness or chafing to the user of the fluid dynamic exerciser 1.

The fluid containing enclosure 2 may be a cylindrical, tubular bag but with each end decreasing in diameter in all radial directions to a point as showin in FIG. 4. The end of fluid containing enclosure 2 may be pleated, i.e. folded over onto itself many times with the folds in substantial alignment with the axis of the enclosure and with the very end being cut so that one split portion 32 could enter one handle strap side piece 15, and a second split portion 33 could enter a second handle strap side piece 36.

Illustrated herein is simply one method which has been utilized as a connecting means 16 or connecting means 20 to connect the handle assembly 4 or handle assembly 5 to the fluid containing enclosure 2. Any desired method of connecting the handle assembly 4 or handle assembly 5 to the fluid containing enclosure 2 may be utilized within the scope of this invention.

FIG. 8 is an illustrative view of a first method of utilizing handle assembly 4 within hand 37. Hand 37 is shown with fingers 38, 39, 40, and 41, and thumb 42. In FIG. 8, the fingers 38, 39, 40, and 41 are holding the outer portion of the handle assembly 4.

FIG. 9 is an illustrative view of a second method of utilizing handle assembly 4 within hand 37. In FIG. 9, the outer portion of handle assembly 4 is turned inside out, with the outer portion of handle assembly 4 held against the back of the hand 37 and the handle strap side pieces 15 and 36 (not shown) held between the thumb 42 and the finger 38.

FIG. 10 is an illustrative view of a third method of utilizing handle assembly 4 within hand 37. In FIG. 10, the handle assembly 4 is held similar to the method of FIG. 9, except that the handle strap side pieces 15 and 16 are held between fingers 39 and 40.

There may be many ways for fluid dynamic exerciser 1 to be held by the user. For example, the handle strap side pieces 15 and 36 could be placed between any two fingers and the outer portion of the handle assembly 4 may be held in various manners. The fluid dynamic exerciser 1 could actually be held at the connecting means 16 or on the end portion of the fluid containing enclosure 2, if desired.

The hand-hold on the fluid dynamic exerciser 1 changes the utilization of the fluid dynamic exerciser 1 for different conditioning. In static exercise equipment, the hands and lower arms may be fatigued faster than the other muscles of the body. By changing the hand-hold on the fluid dynamic exerciser 1, various muscles can be relaxed, eliminating premature tiring by the user of the fluid dynamic exerciser 1.

The fluid dynamic exerciser 1 is a new concept in physical conditioning. The muscles of the body are being coordinated with the dynamics of the fluid and the motion of the fluid. Gravitational forces and centrifugal forces are being utilized to condition and strengthen the muscles of the body.

With conventional-type weights, movements of the body are restricted. The fluid dynamic exerciser allows for movements in a vertical and horizontal plane, along with rotational-type movements. Small muscles of the body necessary for coordination are conditioned. The handle means can be held in many different ways, each different hand-hold gives different muscle responses. The same type movement of the fluid dynamic exerciser, with a variation of the position of the feet and shifting of the weight, may exercise a totally different group of muscles. A different hand-hold utilizing a similar foot position and movement may exercise different muscles. The hand-hold can be varied to prevent muscle fatigue in the hands and lower arms.

The covering portion 35 may be any desired material which will not interfere with the user of the fluid dynamic exerciser 1. The handle padding 14 is optional and may be utilized for the comfort of the user. The handle strap side pieces may be constructed of very flexible material which can be basically a hollow tube in order to be utilized in the connecting means 16 and 20, as shown herein, or could be a shaped piece connected within the connecting means 16 and 20 in a different manner. The handle strap side pieces may be constructed of a heat-shrink material that will not expand or contract.

The fluid containing enclosure 2 is basically a flexible chamber which holds a fluid. An opening or a plurality of openings, such as fill-holes 21, 22, and 23, may be utilized to place in or remove fluid from the fluid containing enclosure 2.

A plurality of seals may be used in the connecting means; a heat seal, secondary sealing means such as stitching, and a pressure-relieving seal all may be utilized. Any type of sealing means may be utilized which will prevent the fluid from escaping through the connecting means when the fluid dynamic exerciser 1 is utilized.

The fluid containing enclosure 2 may be a cylindrical, tubular bag, or may be of any shape desired. Differing amounts of fluid may be placed into the fluid containing enclosure 2, depending upon the exercising program being utilized by the individual user. Each individual user may desire a different quantity of fluid within the fluid containing enclosure 2. The addition or subtraction of fluid from the fluid containing enclosure 2 will change the exercise program, even though the same movements of the fluid dynamic exerciser 1 might be utilized.

One or more fill-holes may be left open in order to change the amount of fluid within the fluid containing enclosure 2, without interrupting the movement of the fluid dynamic exerciser 1. If the plurality of fill-holes is on the same side of the fluid containing enclosure 2 as illustrated in FIG. 4, the fluid may be expelled through the open fill-hole or fill-holes by flipping the fluid containing enclosure 2 so that the fill-holes face outward from the user until the desired amount of fluid is expelled. When using either fill-hole 21 or 23 for this purpose, the centrifugal force and gravitational force on the fluid will prevent a large amount of fluid from being expelled when the fluid dynamic exerciser is being utilized and the fill-hole or fill-holes 21 and 23 face the user. The variation of the weight of the fluid by this method will result in a fluid flow from the fluid dynamic exerciser which should only be attempted in the appropriate locations, such as on a beach. The fluid may also be expelled in this manner in order for the user to adjust the quantity of fluid in the fluid containing enclosure to a comfortable weight. After a quantity of fluid has been expelled and the fluid dynamic exerciser is comfortable, the fill-hole cover 26 can be re-attached to prevent any further fluid from escaping from the fluid containing enclosure.

The hands of the person may be completely open while utilizing the fluid dynamic exerciser, with the force of the movement of the fluid 3 being projected to other portions of the body. The fluid dynamic exerciser can be utilized for a systematic set of exercises for all parts of the body. The fluid dynamic exerciser may be moved in a variety of movements above, below, in front of, or behind the torso of the person utilizing the device.

Exercises can be utilized for one particular part of the body, or a variety of movements and exercises can be utilized for a variety of portions of the body. The effectiveness of the exercising of various portions of the body can be increased or reduced by moving the fluid dynamic exerciser at differing speeds and increasing the quantity of fluidwithin the fluid containing enclosure.

The fluid dynamic exerciser is portable. The fluid dynamic exerciser may be emptied of fluid and stored in a compact area. The fluid dynamic exerciser can be made in different lengths, if desired. When all the fluid is removed, the fluid dynamic exerciser is lightweight.

The fluid dynamic exerciser could be utilized in a non-gravitational field. For example, astronauts could utilize the fluid dynamic exerciser for exercise purposes in space. The fluid dynamic exerciser can be used as a form of physical conditioning for the blind. The fluid dynamic exerciser is a mental and physical exerciser, with the movement of the fluid within the fluid containing enclosure relaxing the user with a soothing sound of moving fluid.

The fluid dynamic exerciser is a portabale conditioning apparatus which produces feedback relative to physical articulations of the human body. The basic sensory feedback produced by the fluid dynamic exerciser is the dynamic forces which are directly proportional to the basic and transitional movements of the fluid dynamic exerciser.

The fluid dynamic exerciser produces a controllable medium allowing non-resistive interaction between the dynamic potential of fluid and the material articulation of the body through the device's active and reactive sensibilities, through independent and combined movements, and through vertical, horizontal, and rotational planes. The developmental aspects conditioned through interaction with the fluid dynamic exerciser are a combination of resistive, non-resistive, and re-directional forces applied to the body which have to be physically experienced and mentally interpreted to obtain a degree of control and proficiency.

Specific muscles are utilized to set the fluid in motion. Once set in motion, the fluid will constantly seek its own center of gravity.

The subconscious response of the body relative to the forces generated by the fluid dynamic exerciser is resistance. The resistance reaction to the dynamic feedback will be physically experienced as lack of balance due to the inefficiency of coordinating transitional muscle groups which are necessary to control the flow of fluid within the fluid dynamic exerciser. Once the lack of body control is experienced on a conscious level, interpretive mental and physical interactions combine to evaluate and re-program the conditional reflex of resistance to duplicate the dynamic efforts of fluid in motion. The resistive, non-resistive, and re-directional forces produced by the fluid dynamic exerciser are determined by the quantity of fluid, the speed of the physical movement, and the distance of the moving mass or fluid from the body's center of gravity.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for use by a person for dynamically exercising muscles comprising:

an elongated substantially cylidrically shaped flexible enclosure which decreases in diameter in all radial directions toward each end to a point, each end of said enclosure being pleated into a closed condition by being folded over onto itself many times with the folds being in substantial alignment with the axis of the enclosure;

first and second flexible holding strap means operable to be held by said person in his left and right hands, respectively, said strap means including end portions which fit around the pleated ends of said enclosure;

first and second connecting means securing the ends of said first and second strap holding means, respectively, around the opposite pleated ends of said flexible enclosure, and a liquid only partially filling said flexible enclosure whereby said flexible enclosure can easily bend and wherein movement of said person's hands holding said holding means causes said liquid to move within said flexible enclosure resulting in dynamically exercising said person's muscles.

2. A device according to claim 1 wherein said flexible enclosure contains one or more fill-holes in order to add or subtract quantities of said liquid from said flexible enclosure.

3. A device according to claim 2 wherein said quantities of said liquid may be removed from said flexible enclosure while utilizing said device.

4. A device according to claim 1 wherein said first holding strap means comprises a flexible, tubular strap.

5. A device according to claim 4 wherein said first connecting means comprises:

a. a plurality of split ends of said flexible enclosure;

b. a plurality of ends of said flexible, tubular strap within which said plurality of split ends of said flexible enclosure is placed; and c. sealing means operative to seal said plurality of split ends of said flexible enclosure within said plurality of ends of said flexible, tubular strap.

6. A device according to claim 5 further comprising a secondary sealing means further sealing said plurality of split ends of said flexible enclosure within said plurality of ends of said flexible, tubular strap.

7. A device according to claim 6 wherein said secondary sealing means comprises stitches placed through said plurality of split ends of said flexible enclosure and said plurality of ends of said flexible, tubular strap.

8. A device according to claim 6 further comprising a pressure-relieving seal placed over said secondary sealing means and said sealing means to insure that said liquid within said flexible enclosure does not escape through said first connecting means.

9. A device according to claim 8 wherein said second connecting means is constructed in the same manner as said first connecting means.

10. A device according to claim 9 wherein said second holding means is constructed in the same manner as said first holding strap means.

11. A device according to claim 10 wherein said first holding strap means and said second holding strap means have handle padding for the comfort of said person.

* * * * *